US008083159B2

(12) United States Patent
Leuliet et al.

(10) Patent No.: US 8,083,159 B2
(45) Date of Patent: Dec. 27, 2011

(54) PUSH-BUTTON NOZZLE FOR LIQUID PRODUCT DISPENSER

(75) Inventors: David Leuliet, Woincourt (FR); Francois Nicolle, Tourville la Chapelle (FR)

(73) Assignee: Rexam Dispensing Systems S.A.S. (FR)

( * ) Notice: Subject to any disclaimer, the term of this patent is extended or adjusted under 35 U.S.C. 154(b) by 177 days.

(21) Appl. No.: 11/955,558

(22) Filed: Dec. 13, 2007

(65) Prior Publication Data

US 2008/0164347 A1 Jul. 10, 2008

Related U.S. Application Data

(63) Continuation of application No. PCT/FR2006/001113, filed on May 17, 2006.

(30) Foreign Application Priority Data

Jun. 21, 2005 (FR) ..... 05 06278

(51) Int. Cl.

| | |
|---|---|
| ***B05B 7/32*** | (2006.01) |
| ***F23D 11/24*** | (2006.01) |
| ***F23D 14/28*** | (2006.01) |
| ***F23D 14/34*** | (2006.01) |
| *B05B 7/04* | (2006.01) |

(52) U.S. Cl. ..... 239/337; 239/349; 239/340; 222/402.1; 222/402.17; 222/402.24

(58) Field of Classification Search ..... 239/337, 239/341

See application file for complete search history.

(56) References Cited

U.S. PATENT DOCUMENTS

| | | | | |
|---|---|---|---|---|
| 4,182,496 | A * | 1/1980 | Burke | 239/492 |
| 5,158,215 | A * | 10/1992 | Comment | 222/396 |
| 5,901,907 | A * | 5/1999 | Hildebrandt | 239/337 |
| 6,193,115 | B1 * | 2/2001 | Das | 222/401 |
| 6,626,379 | B1 * | 9/2003 | Ritsche et al. | 239/337 |
| 7,104,469 | B2 * | 9/2006 | Merk et al. | 239/302 |
| 7,104,470 | B2 * | 9/2006 | Jaeger et al. | 239/333 |
| 7,484,678 | B2 * | 2/2009 | Morrison | 239/302 |

FOREIGN PATENT DOCUMENTS

| | | |
|---|---|---|
| FR | 2 622 478 | 5/1989 |
| FR | 2 671 329 | 7/1992 |
| FR | 2 767 311 | 2/1999 |

OTHER PUBLICATIONS

International Search Report, Sep. 21, 2006, 2 pages.

* cited by examiner

*Primary Examiner* — Len Tran
*Assistant Examiner* — James Hogan
(74) *Attorney, Agent, or Firm* — St. Onge Steward Johnston & Reens LLC

(57) ABSTRACT

The invention concerns a push-button nozzle for liquid or semi-liquid product dispenser, said dispenser comprising means for delivering the product under pressure which are mounted on the product container bottle and which comprise an ejection tube projecting outside. The invention is characterized in that said nozzle comprises a needle valve tightly closing the spraying orifice provided at the end of said nozzle, means for being fixed on the ejection tube and means for supplying products to a turbulence chamber located proximate said orifice.

6 Claims, 4 Drawing Sheets

PUSH-BUTTON NOZZLE FOR LIQUID PRODUCT DISPENSER

CROSS-REFERENCE TO RELATED APPLICATIONS

The present application is a continuation of pending International patent application PCT/FR2006/001113 filed on May 17, 2006 which designates the United States and claims priority from French patent application 0506278 filed on Jun. 21, 2005, the content of which is incorporated herein by reference.

FIELD OF THE INVENTION

This invention relates to a spraying nozzle for a liquid or semi-liquid product.

The invention more particularly relates to the spraying nozzles fitted on pharmaceutical or cosmetic products dispensers such as nasal sprayers.

BACKGROUND OF THE INVENTION

The known nozzles generally comprise an extending outer part provided, at its lower part, with a collar forming a push-button, and an internal tube which supplies, at its upper part, an end nozzle and connected, at its lower part, to the ejection tube of the means for delivering the product under pressure, such as a pump or a valve, mounted on the neck of a bottle containing the product.

Such nozzles, however, have the disadvantage of not including their own sealing means.

As a matter of fact, the passages formed inside the nozzle to route the liquid from the end of the ejection tube up to the spraying nozzle outlet are not provided with any type of element which may, guarantee a temporary closure.

Although the pump or the valve are equipped with such means which preserve the water tightness of the bottle, such unsatisfactory tight condition at the level of the nozzle also that of prejudicial to the product in particular in pharmaceutical and cosmetic fields.

This problem more particularly concerns the volume of waste product which remains in the above-mentioned passages of the nozzle, between two successive sprayings. Besides, the traditional nozzles do not make it possible to carry out a spraying which is regular as regards the flow rate, the pressure, the jet geometries, from the beginning to the end of the restitution of a product dose and independently from the manual squeezing velocity.

Such discontinuity is prejudicial to the users' comfort and to the assimilation of the product in the case of a drug.

SUMMARY OF THE INVENTION

The aim of the invention is to solve this problem and to supply the nozzle with a reinforced-tightness specific structure.

This aim is reached, according to the invention, using a nozzle characterized in that said nozzle comprises a needle valve guaranteeing the tight closing of the spraying opening arranged at the end of said nozzle, means for fixing on the ejection tube and means for supplying the product to a turbulence chamber located close to said vent.

According to an advantageous characteristic, the fixation means come in a nozzle barrel, one of the ends of which has a ring for the connection to the ejection tube of the delivery means.

According to an advantageous variation, the upper end of the ejection tube is provided with a socket which can fit into a ring of said barrel, the diameter of said ring being such that it can fit into said sleeve with a radial tightening.

According to a specific characteristic, said barrel includes a recoil chamber which is tightly closed with a peripheral tight ring carried by a collar of said needle valve.

According to another characteristic, the nozzle comprises a control enclosure for checking the tightness of the recoil chamber which may be communicating with air-operated measuring means.

According to another variant, said means of supplying the product to the turbulence chamber comprise a fixed core, through which goes a central bore for guiding an axial rod integral with said valve, said core having means for connection with said barrel and arranging a terminal channel which opens, at upper part, laterally into the turbulence chamber.

According to still another characteristics, the means for supplying the liquid comprise an upstream channel for supplying the liquid which is arranged through said barrel, and the inlet of which is located close to the means for fixing on the ejection tube, whereas the outlet opens to the outside of said barrel.

According to other characteristics, the nozzle includes an internal sleeve in which said barrel is fitted.

Preferably, said internal sleeve has a diameter greater than that of said barrel, so as to define an intermediate annular space for said liquid product, said passage constituting at least partially, the means for supplying said product from the end of the ejection tube up to the neighborhood of said spraying hole.

According to a special characteristic, said nozzle has a peripheral zone for resting arranged close to the fixation means on the end of the ejection tube.

The nozzle according to the invention provides a reinforced tightness and thus makes it possible to guarantee the physicochemical properties, as well as the sanitary quality of the product, whichever the volume of the container and the delivered doses.

Besides, the needle valve is compact and is more particularly well-incorporated into the structure of the nozzle while contributing, through a sudden breaking of tightness like a valve, to the obtaining, during the spraying, of a very fine and intense dispersion of the product.

The nozzle according to the invention separates the functions of guiding the mobile needle and circulating the product in the terminal channel supplying the internal nozzle.

Thus, when the needle recoils to release the vent, the profile of the channel is not modified and the sections of the passage for the product remain unchanged during the whole stroke of the needle which guarantees a stability of the supplying parameters (velocity, pressure) of the nozzle and thus the evenness and homogeneity of the spraying.

Eventually, the connection of the nozzle to the delivering means is particularly simple and stable which guarantees an easy assembling and makes it possible, when it is activated by pushing it, to preserve the axial alignment of the nozzle on the bottle which is a necessary condition to have a reliable and accurate dose.

BRIEF DESCRIPTION OF THE DRAWINGS

Other objects and advantages of the invention will appear adequate when reading the description while referring to the appended drawings in which.

DETAILED DESCRIPTION OF THE INVENTION

The nozzle shown in FIGS. 1 to 4 shows a cone-shaped outer enclosure 5 having a central axis defining, at least in the upper part, the wall of an internal pipe 50 which opens upwards outside, via the small diameter spraying hole 50*a* and extends downwards through an internal sleeve 51.

Figure 1:
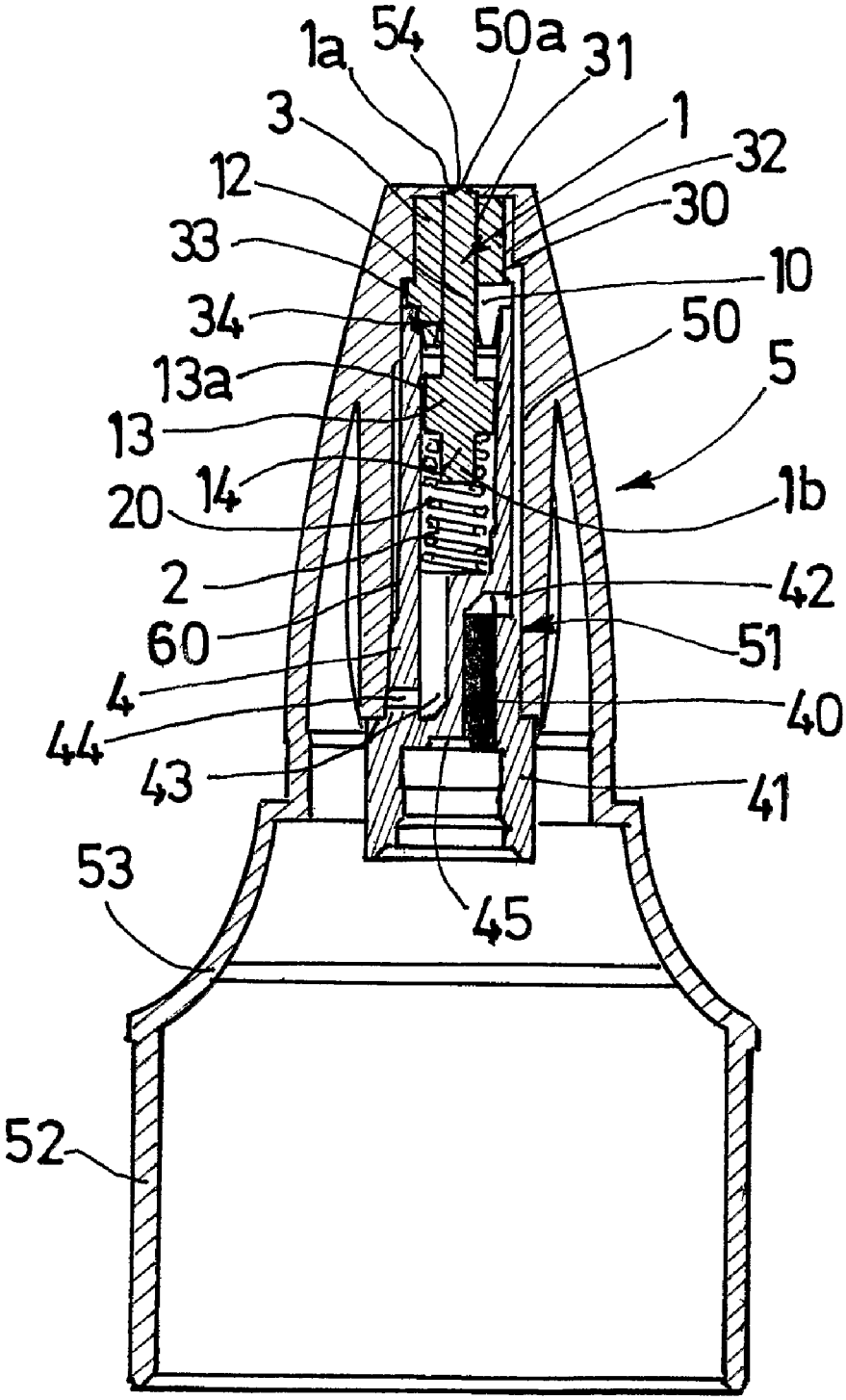
FIG. 1 shows a cross-sectional view of an embodiment of the nozzle according to the invention.
Figure 2:
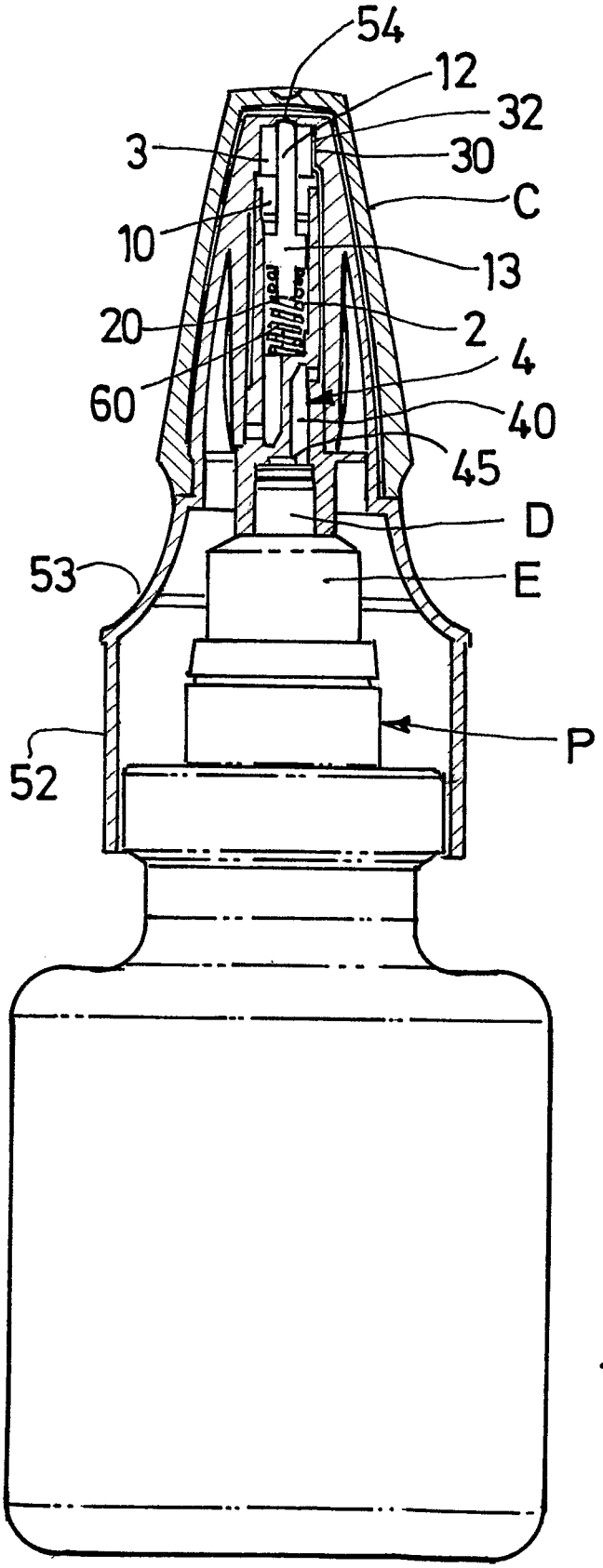
FIG. 2 shows a cross-sectional view of the embodiment of FIG. 1 mounted on a pump which is assembled to a bottle.

The outer enclosure 5 has a lower skirt 52 which covers the neck of the bottle, as shown in FIG. 2.

A removable cover C can advantageously cover the upper part of the enclosure 5, as also shown in FIG. 2.

The enclosure 5 of the nozzle has a concave peripheral area 53 arranged close to its means for fixing onto the end of the ejection tube E and making it possible to manually press the nozzle to activate the product delivery means.

The nozzle also includes a valve accommodated in the pipe 50, which is supplied with a needle 1, the upper end of which 1*a* cooperates with the outlet 50*a* of the turbulence chamber 54 thus forming a spraying nozzle.

Therefore, the end 1*a* has a pin, the profile of which matches that of the hole 50*a* in which it is introduced to close it tightly, like a plug.

The lower end 1*b* of the needle 1 cooperates with a helical return spring 2 which is carefully weighted, as a function of the pressure threshold desired upon the opening of the valve and the parameters desired for the spraying jet.

When the valve is closed, the spring activation 2 pushes the needle 1 upwards, in order to secure the tightness of the chamber 54.

Conventionally, the turbulence chamber 54 is located inside the nozzle close to the hole 50*a* and comprises tangential grooves arranged on the nozzle internal wall.

The needle 1 is composed of an axial rod 12 extending downwards by a collar 13 carrying a peripheral ring 13*a*, and then by a lower wedging and centering finger 14, which engages into the spring 2.

In the upper part, the internal pipe 50 is provided with a substantially cylindrical core 3. Through the core 3 is arranged a central guiding bore 31, in which the axial rod 12 of the needle 1 may slide. The core 3 is immobilized in its upper housing by a radial tightening and its upper face partially closes the grooves of the turbulence chamber 54 which laterally open onto the terminal channel 30 for routing the product, defined between a longitudinal flat section 32 of the core 3 and the wall of the internal conduit 50 of the nozzle.

The nozzle includes a barrel 4 having the shape of an added part which is engaged into the internal conduit 50. The lower end of the barrel has a ring 41 which guarantees the connection to the ejection tube E of means for delivering the product under pressure of the pump P or valve type (refer to FIG. 2).

The end of the ejection tube E is provided with a socket D having an upper outlet for the liquid under pressure which is fitted in the connection ring 41 of the barrel 4.

The diameter of the ring 41 is such that it can receive the socket D with a tight radial tightening.

The barrel 4 defines a recoil chamber 20 in which the spring 2 is accommodated and which is tightly closed, at its upper part, by the collar 13 and the tight ring 13*a* of the mobile needle 1. The barrel 4 includes the cross-sectional plate 42 which is used as a rest surface for the spring end 2 inside the channel 20 and hanging over an enclosure 43 which makes it possible to check the tightness while communicating with air-operated measuring means.

The enclosure 43 has a side hole 44 which makes it possible on the one end, to discharge the compressed air while the needle is introduced into the barrel 4 and, on the other end to measure the pressure, which aims at checking the tightness between the collar 13 and its tight ring 13*a* with the barrel 4.

The barrel 4 is fitted into the internal conduit 50 until the ring 41, the diameter of which is larger than that of the barrel, abuts upwards against the lower edge of the internal sleeve 51.

In its upper part, the edge of the sleeve 51 rests against a radial shoulder 33 carried by the core 3 which guarantees its holding and its wedging into the channel 50 and makes it possible to guarantee the integrity of the pre-compression cell 10.

The core 3 also includes means for a connection with the barrel 4, in the form of a set of anchoring pads 34 fitted into the upper part of the barrel 4 while defining a product pre-compression cell 10 which is positioned under the core 3 and above the collar 13.

The cell 10 supplies the terminal channel 13, downstream, with the product and the internal pressure inside this cell commands the displacement of the needle 1 and thus the opening and the closing of the valve.

The means for supplying the product further comprise, at their lower part, an upstream channel 40 for supplying the liquid which is provided inside the barrel 4. The upstream channel 40 is parallel to the axis of the nozzle and has an inlet at its lower end which is located inside the connection ring 41 whereas at its upper end, the outlet opens laterally into the intermediate annular space 60 located between the outer wall of the barrel 41 and the internal wall of the sleeve 51.

The bottom of the ring 41 is provided with a cavity 45 which forms a dead volume opposite the end of the outlet of the socket D and in which the inlet of the channel 40 is arranged.

The space 60 communicates, at its upper part, with the cell 10 and with the terminal channel 30.

FIGS. 3*a* to 3*d* show the progression of the liquid product, into the various portions of the supplying means during the ejection of the product under pressure by pressing on the nozzle.

Figure 3A:
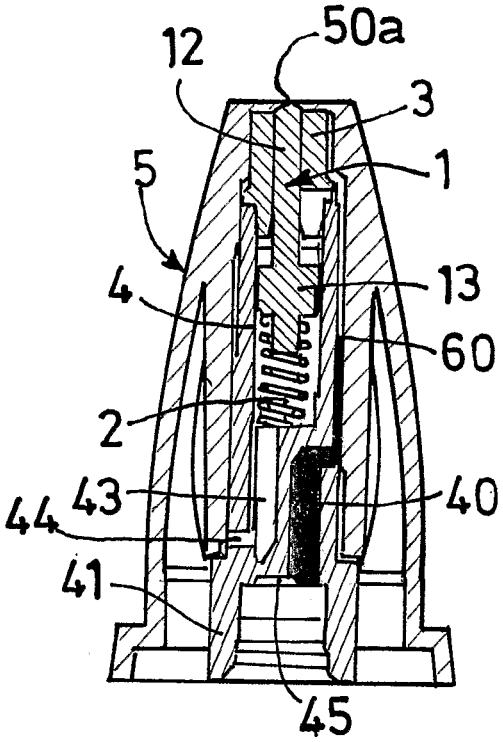
FIGS. 3A to 3D show the nozzle of the preceding figures during the various products dispensing phases.
Figure 3B:
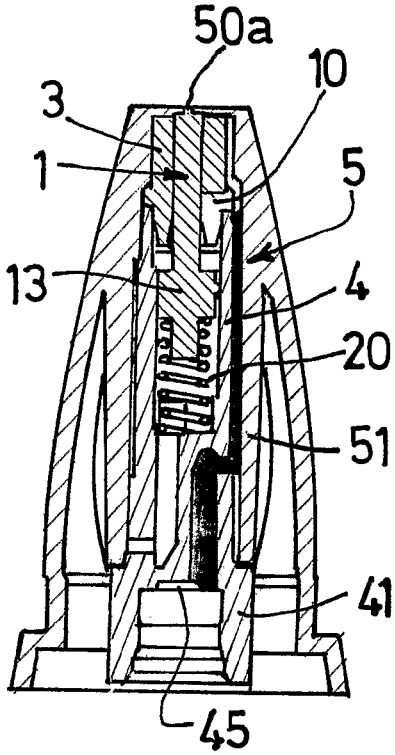
Figure 3C:
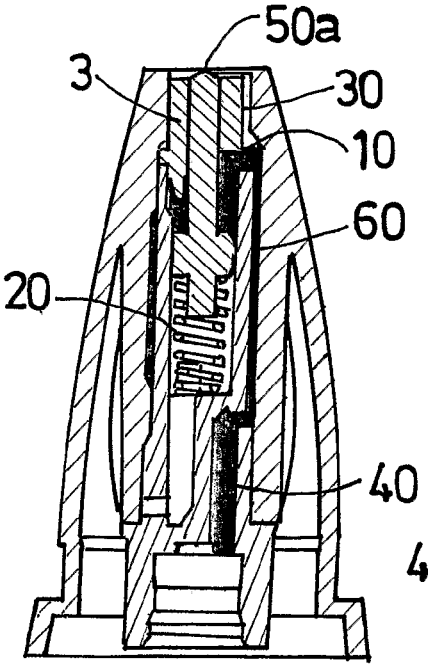
Figure 3D:
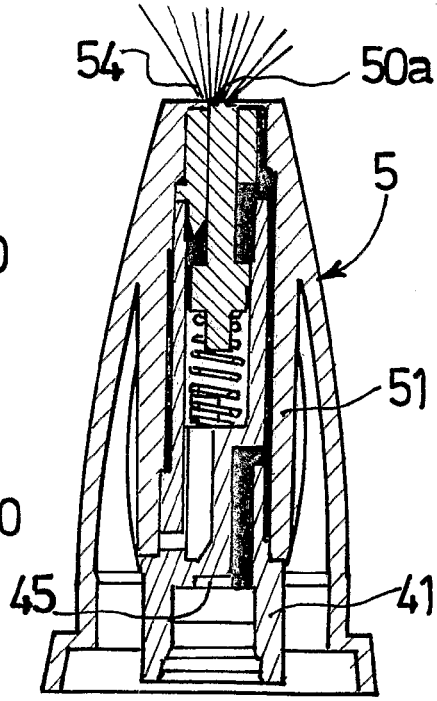
Figure 4:
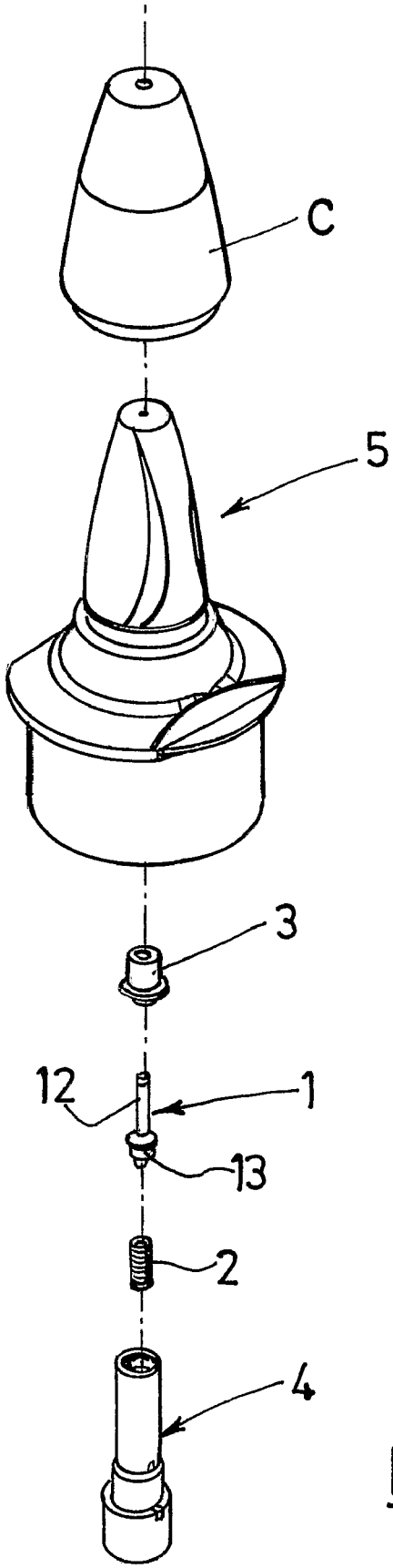
FIG. 4 shows an exploded perspective view of the nozzle of the preceding Figures.

The needle valve is opened when the pressure in the cell 10 reaches a threshold which results in the needle 1 going down into the chamber 20 and when the turbulence chamber 54 is simultaneously under load as shown in FIG. 3*d*.

What is claimed is:

1. A push-button nozzle for a liquid or semi-liquid product dispenser comprising means for delivering the product under pressure which are mounted on a product-containing bottle and provided with an ejection tube projecting outside, said nozzle comprising:

a needle valve for tightly closing a spraying orifice arranged at the end of said nozzle, said needle valve comprising an integral collar, displacement of which needle valve is commanded by an internal pressure inside a pre-compression cell, said pre-compression cell formed above said collar;

means for fixing on the ejection type tube, said fixing means comprising a barrel, one of the ends of which having a ring for a connection to the ejection tube and defining a recoil chamber tightly closed by a peripheral sealing ring supported by said collar of said needle valve, said recoil chamber formed beneath said collar of said needle valve;

means for supplying the product to a turbulence chamber located close to said orifice, said means comprising a core, through which is provided a central bore for guiding an axial rod formed above said collar and integral with said valve, said core having means for connection with said barrel and arranging a downstream side channel which opens laterally at the upper part of the turbulence chamber, said side channel comprising an annular channel at least partially surrounding the pre-compression cell, said pre-compression cell defined under said core and above said collar; and an inner sleeve in which said barrel is fitted, said inner sleeve defining an intermediate annular space for said liquid product, said space composing at least partially the means for supplying said product from the end of the ejection tube up to the vicinity of said spraying orifice, wherein said side channel divides flow of the product and separately feeds product to the pre-compression cell and to the turbulence chamber so that the nozzle separates the functions of guiding the needle valve and circulating the product to the turbulence chamber, and wherein a cross-section of said side channel remains unchanged during displacement of said needle valve.

2. A nozzle according to claim 1, characterized in that said upper end of the ejection tube is provided with a socket fitting into the ring of said barrel, the diameter of said ring being such that it can receive said socket with a radial tightening.

3. A nozzle according to claim 1, characterized in that it comprises an enclosure for checking the tightness of said recoil chamber which may be communicating with air-operated measuring means.

4. A nozzle according to claim 1, characterized in that said means for supplying the liquid comprise an upstream channel for supplying a liquid which is arranged through said barrel and the inlet of which is located close to a fixation means on the ejection tube whereas the outlet opens outside said barrel.

5. A nozzle according to claim 1, characterized in that it has a rest peripheral area arranged close to the fixation means on the end of the ejection tube.

6. A nozzle according to claim 2, characterized in that it comprises an enclosure for checking the tightness of said recoil chamber which may be communicating with air-operated measuring means.

* * * * *